US009022751B2

(12) United States Patent
Zheng et al.

(10) Patent No.: US 9,022,751 B2
(45) Date of Patent: May 5, 2015

(54) ADVECTION FAN AND AN IMPELLER THEREOF

(75) Inventors: Yuan-Jie Zheng, Kaohsiung (TW); Chih-Hao Chung, Kaohsiung (TW); Tso-Kuo Yin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 201 days.

(21) Appl. No.: 13/616,358

(22) Filed: Sep. 14, 2012

(65) Prior Publication Data

US 2013/0243628 A1 Sep. 19, 2013

Related U.S. Application Data

(63) Continuation-in-part of application No. 13/418,477, filed on Mar. 13, 2012.

(51) Int. Cl.
*F04D 25/06* (2006.01)
*F04D 25/08* (2006.01)

(52) U.S. Cl.
CPC ..... *F04D 25/08* (2013.01); *F04D 25/0653* (2013.01)

(58) Field of Classification Search
CPC . F04D 13/024; F04D 25/0653; F04D 25/064; F04D 25/08
USPC ..... 417/420, 423.1, 423.7
See application file for complete search history.

(56) References Cited

U.S. PATENT DOCUMENTS

| | | | | |
|---|---|---|---|---|
| 4,164,690 | A | 8/1979 | Muller et al. | 318/400.41 |
| 4,885,488 | A * | 12/1989 | Cox | 310/68 R |
| 5,176,509 | A | 1/1993 | Schmider et al. | 417/423.7 |
| 5,944,497 | A | 8/1999 | Kershaw et al. | 417/423.8 |
| 6,232,690 | B1 * | 5/2001 | Schmider | 310/156.37 |
| 7,045,919 | B1 | 5/2006 | Lin | 310/67 R |
| 7,061,155 | B1 | 6/2006 | Lee | 310/261.1 |
| 7,474,032 | B2 | 1/2009 | Horng et al. | 310/268 |
| 7,619,337 | B2 | 11/2009 | Kasai et al. | 310/89 |
| 7,695,256 | B2 | 4/2010 | Horng et al. | 417/420 |
| 8,324,766 | B2 | 12/2012 | Chen et al. | 310/62 |
| 2009/0148086 | A1 | 6/2009 | Kuo et al. | 384/440 |

FOREIGN PATENT DOCUMENTS

| | | |
|---|---|---|
| TW | 553323 | 9/2003 |
| TW | M350746 | 2/2009 |

* cited by examiner

*Primary Examiner* — Peter J Bertheaud

(74) *Attorney, Agent, or Firm* — Alan D. Kamrath; Kamrath IP Lawfirm, P.A.

(57) ABSTRACT

An impeller includes a metal base plate, a shaft and a plurality of plastic blades. The metal base plate includes a shaft-coupling portion, a peripheral portion, and first and second surfaces. The first surface faces away from the second surface in a first direction, and the second surface faces away from the first surface in a second direction. The metal base plate is flat between the shaft-coupling portion and the peripheral portion. The first surface has a permanent magnet. The shaft has a fixing end coupled with the shaft-coupling portion, as well as a free end extending axially in the first direction. Each plastic blade has a coupling portion coupled with the peripheral portion, as well as an air-driving portion axially extending in the second direction. The impeller may be rotatably coupled with a driving module. The driving module is installed in a fan frame to form an advection fan.

27 Claims, 10 Drawing Sheets

ADVECTION FAN AND AN IMPELLER THEREOF

CROSS REFERENCE TO RELATED APPLICATIONS

This is a continuation-in-part application of U.S. patent application Ser. No. 13/418,477 filed on Mar. 13, 2012.

BACKGROUND OF THE INVENTION

1. Field of the Invention

The present invention generally relates to an advection fan and an impeller thereof and, more particularly, to an advection fan that draws and expels air in a radial direction, as well as an impeller thereof 2. Description of the Related Art Conventional cooling fans include axial-flow fans and blower fans. The axial-flow fan has an axial air inlet and an axial air outlet opposite to the axial air inlet. Air can be drawn via the axial air inlet and then expelled via the axial air outlet. The blower fan has an axial air inlet in the axial direction and a radial air outlet in the radial direction of the fan. Air can be drawn via the axial air inlet and then expelled via the radial air outlet for cooling purposes.

However, since the axial-flow fan expels air only in the axial direction rather than in the radial direction, the axial-flow fan must be mounted on the top of an electronic device to be cooled, such as a Central Processing Unit (CPU) of a computer. As a result, the height of the electronic device cannot be reduced. In addition, since the blower fan draws air via the axial air inlet (draws air in the axial direction) and expels air via the radial air outlet (expels air in the radial direction), the blower fan cannot be applied to electronic devices that draw air in the radial direction, such as a handset or a Personal Digital Assistant (PDA).

In light of the problems, other advection fans capable of drawing and expelling air in the radial direction were developed to fit the needs, as they can be applied to the electronic devices that draw air in the radial direction. However, since modern electronic devices usually have a miniature design, the height of the impeller of the advection fan must be efficiently reduced without affecting the air-driving capacity of the advection fan. The impeller of the advection fan is integrally formed of plastic material or integrally formed by punching of metal material. When the impeller is integrally formed into a predetermined shape by plastic material, the impeller may have a smaller structural strength if the impeller has a smaller thickness. Although the thin impeller may have a larger structural strength when it is integrally formed by punching of metal material, the costs are increased if a larger amount of metal material is used. The weight of the impeller is also increased when the motor drives the impeller to rotate, affecting the overall operation efficiency of the motor.

Referring to FIG. 1, Taiwan Patent No. M350746 discloses a thin rotor 8 having a thin impeller that is a common impeller design currently available in the market. The rotor 8 has a metal housing 81, a shaft 82 coupled to a center of the housing 81, and a metal blade frame 83 extending outwards from the periphery of the housing 81 in the radial direction. The metal blade frame 83 is coupled with a plastic blade portion 84. In this arrangement, although the rotor 8 is thin, the rotor 8 may still have a larger structural strength, since the primary structures of the rotor 8 are the metal housing 81 and the metal blade frame 83. Furthermore, the rotor 8 also has a lower cost, since the structure that is used to drive air is made of plastic (the plastic blade portion 84), allowing the rotor 8 to be manufactured into a thin shape with improved structural strength. However, the rotor 8 still has some problems stated below.

First, the rotor 8 is only suitable for use in a blower fan because the air-driving faces of the plastic blade portion 84 face two opposite axial directions of the shaft 82. Thus, although the rotor 8 may have a thin form with improved structural strength, the rotor 8 is not suitable for use in an advection fan.

Second, the rotor 8 has a hub 85 that blocks the airflows that are driven by the plastic blade portion 84. The part of the rotor 8 between the center of the housing 81 (where the shaft 82 is coupled) and the outer periphery of the metal blade frame 83 (where the plastic blade portion 84 is coupled) is not in a flat form. Namely, the structure of the rotor 8 where the housing 81 connects to the metal blade frame 83 forms the hub 85 having a protrusion form. Moreover, the top edge 841 of the plastic blade portion 84 is also not higher than the top face of the hub 85 in an axial direction. As a result, the hub 85 will block the airflows driven by the plastic blade portion 84 when the rotor 8 is installed in an advection fan for driving air into and out of the advection fan in the radial direction, affecting the performance of the rotor 8.

First, the rotor 8 is only suitable for use in a blower fan, because the air-driving faces of the plastic blade portion 84 face two opposite axial directions of the shaft 82. Thus, although the rotor 8 may have a thin form with improved structural strength, the rotor 8 is not suitable for use in an advection fan.

In the above structure, since the blades 922 are formed on the outer circumferential face of the hub 921 and since the top edge of each blade 922 is aligned with the top face of the hub 921, the hub 921 will block the airflows and therefore limit the outputted air volume of the advection fan. Thus, the cooling efficiency of the advection fan is significantly affected. Turbulence and noise also result easily.

In summary, since the hub 85/921 of the thin impeller tends to occupy a larger space in the air channel of the fan whether the impeller is one used in the blower fan or one used in the modern advection fan, the air-driving ability of the fan will be limited. As a result, satisfactory cooling effect is not provided. In light of this, it is necessary to improve the conventional advection fan.

SUMMARY OF THE INVENTION

It is therefore the objective of this invention to provide an advection fan capable of efficiently preventing the disruption to the flow of air when the impeller of the advection guides air into and out of the advection fan in the radial direction.

It is another objective of this invention to provide an impeller consisting of a metal base plate and a plurality of plastic blades. In this structure, the impeller has a smaller thickness and an improved structural strength, rendering the impeller suitable for use in a thin advection fan.

One embodiment of the invention discloses an impeller of an advection fan, which includes a metal base plate, a shaft and a plurality of plastic blades. The metal base plate includes a shaft-coupling portion, a peripheral portion, and first and second surfaces between the shaft-coupling portion and the peripheral portion. A direction the first surface faces away from the second surface is defined as a first direction, and another direction the second surface faces away from the first surface is defined as a second direction. The metal base plate is flat between the shaft-coupling portion and the peripheral portion. The first surface is provided with a permanent magnet. The shaft has a fixing end and a free end. The fixing end is coupled with the shaft-coupling portion of the metal base plate, and the free end extends axially in the first direction. Each plastic blade has a coupling portion and an air-driving portion. The coupling portion is coupled with the peripheral portion of the metal base plate, and the air-driving portion axially extends in the second direction.

In a preferred form shown, each plastic blade has a top edge facing in the second direction and spaced from the second surface of the metal base plate by a height.

In the preferred form shown, the top edges of the plastic blades jointly form a horizontal reference plane. A horizontal air-guiding space is formed between the horizontal reference plane and the second surface of the metal base plate.

In the preferred form shown, the air-driving portions of the plastic blades are annularly arranged to form the horizontal air-guiding space.

In the preferred form shown, the air-driving portions of the plastic blades are located above the second surface of the metal base plate in an axial direction.

In the preferred form shown, the fixing end of the shaft is aligned with or located below the second surface of the metal base plate.

In the preferred form shown, the plastic blades are integrally formed with the peripheral portion of the metal base plate by way of injection molding.

In the preferred form shown, the peripheral portion of the metal base plate forms a saw-toothed shape, a plurality of notches, or one or more bends.

In the preferred form shown, the shaft is coupled with the shaft-coupling portion of the metal base plate via a shaft sleeve.

In the preferred form shown, the shaft sleeve is a plastic shaft sleeve that integrally couples the shaft with the shaft-coupling portion of the metal base plate.

In the preferred form shown, the shaft-coupling portion of the metal base plate forms a plurality of notches or has a saw-toothed inner periphery or a noncircular hole.

In the preferred form shown, the shaft-coupling portion of the metal base plate forms a plurality of notches, has a saw-toothed inner periphery or has a noncircular hole.

In the preferred form shown, the first and second surfaces of the metal base plate are covered with a plastic or rustproof film.

Another embodiment of the invention further discloses an advection fan, which comprises a fan frame, a driving module and an impeller. The fan frame comprises a first cover portion, a second cover portion and a lateral wall portion arranged between the first and second cover portions. The lateral wall portion comprises an air inlet and an air outlet. The driving module is installed in the fan frame. The impeller comprises a metal base plate, a shaft and a plurality of plastic blades. The metal base plate comprises a shaft-coupling portion and a peripheral portion. The metal base plate comprises a first surface and a second surface between the shaft-coupling portion and the peripheral portion. A direction the first surface faces away from the second surface is defined as a first direction, and another direction the second surface faces away from the first surface is defined as a second direction opposite to the first direction. The first surface is provided with a permanent magnet. The shaft is coupled with the shaft-coupling portion of the metal base plate and rotatably coupled with the driving module. Each plastic blade has a coupling portion and an air-driving portion. The coupling portion is coupled with the peripheral portion of the metal base plate, and the air-driving portion axially extends in the second direction.

In another preferred form shown, the driving module comprises a shaft seat and a base plate. The shaft seat is arranged on the first cover portion of the fan frame. The shaft of the impeller is coupled with the shaft seat of the driving module. The base plate is fitted around the shaft seat and includes one face having a coil unit. The permanent magnet of the driving module and the coil unit are spaced from each other by an axial air gap.

In the preferred form shown, the air outlet has a smaller opening than the air inlet.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
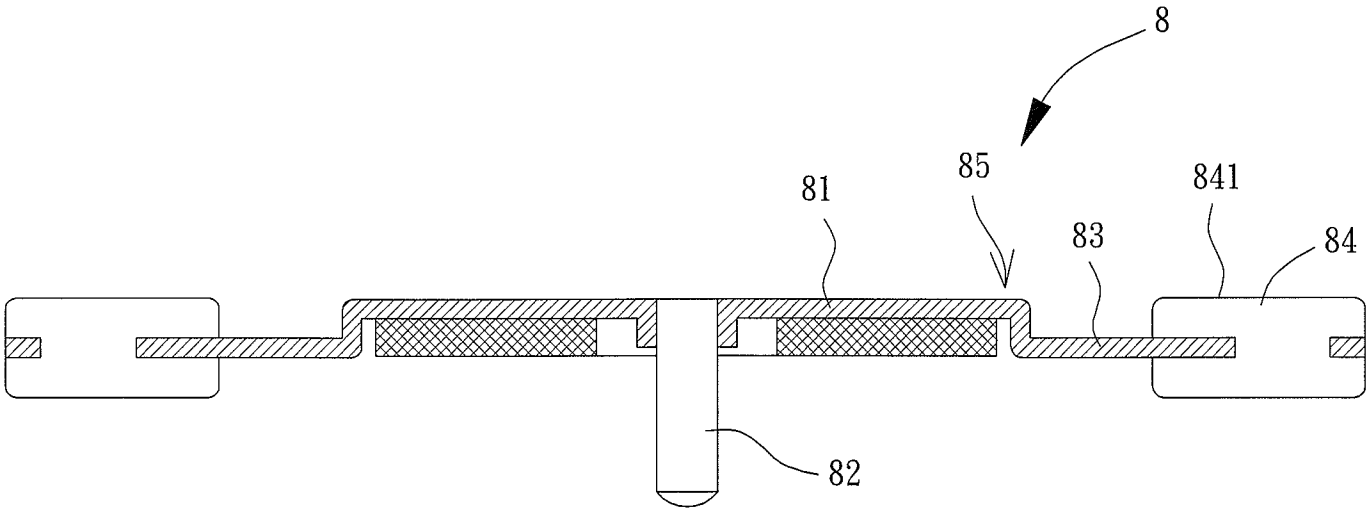
FIG. 1 PRIOR ART
FIG. 1 is a cross-sectional view of a thin rotor of a conventional fan.
Figure 2:
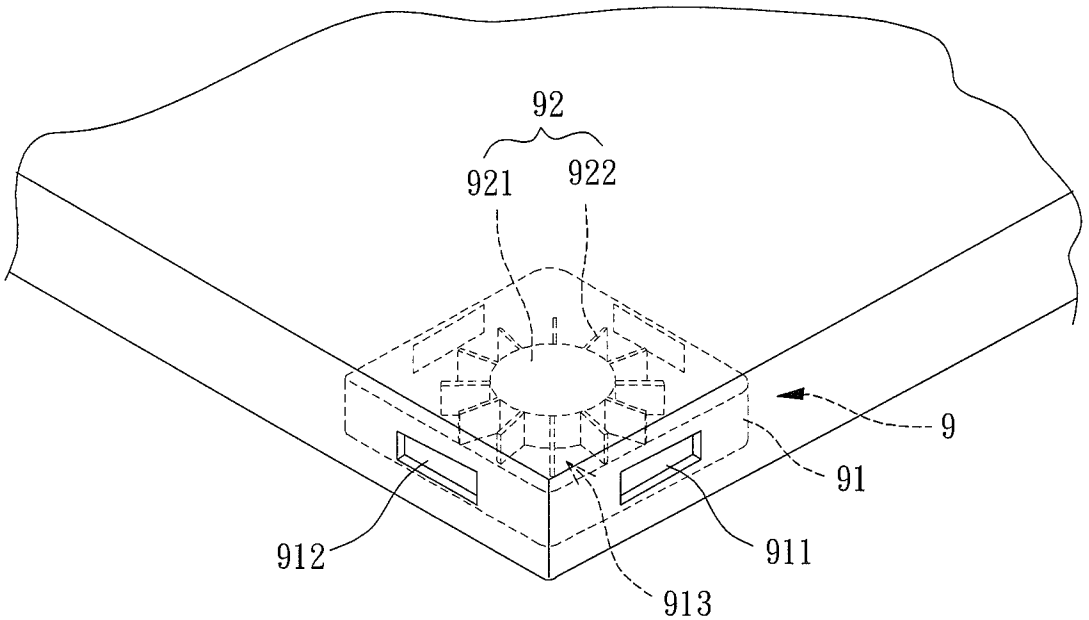
FIG. 2 PRIOR ART
FIG. 2 shows a conventional advection fan installed in an electronic device.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
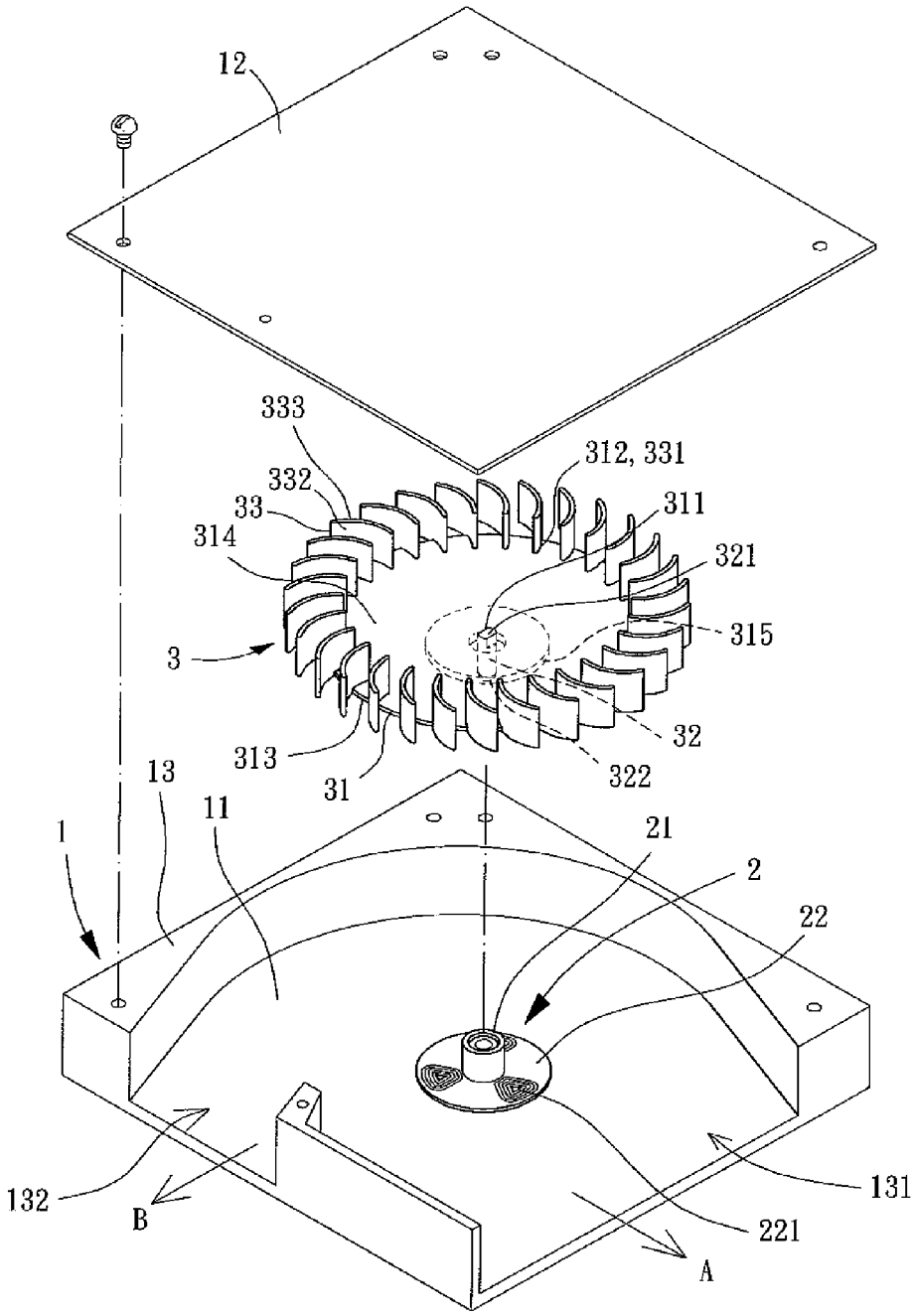
FIG. 3 is an exploded view of an advection fan according to a first embodiment of the invention.
Figure 4:
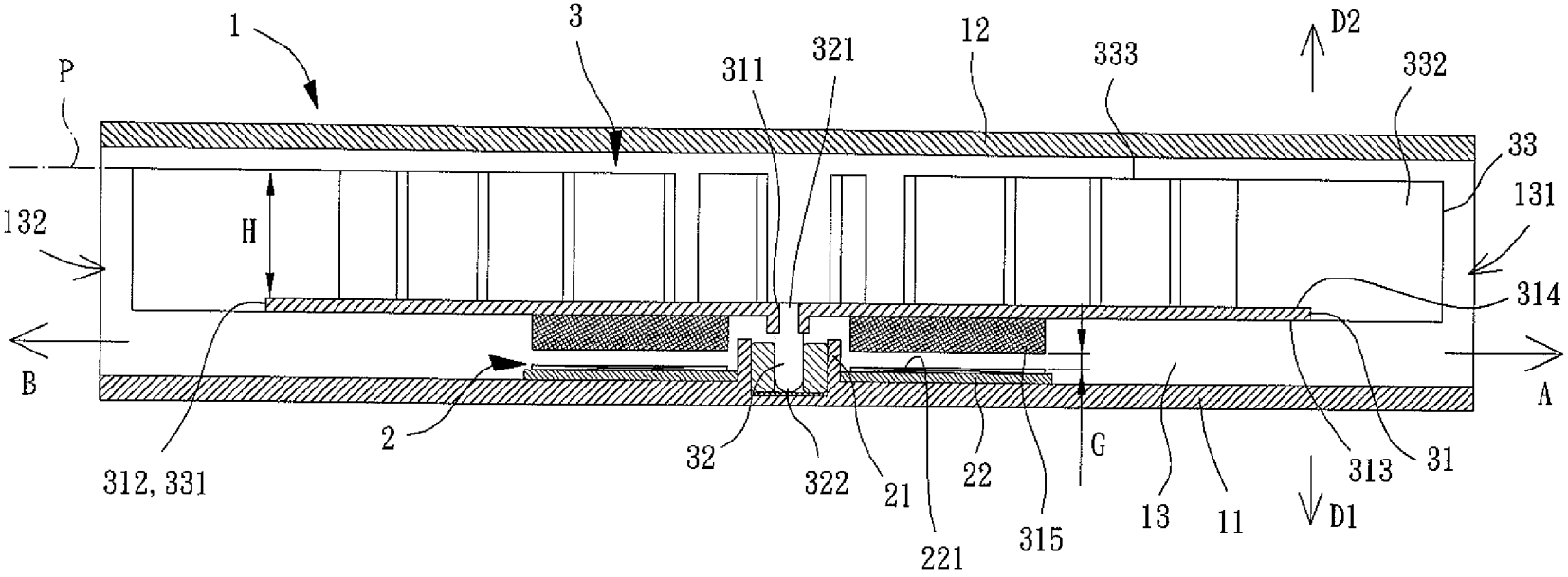
FIG. 4 is a cross-sectional view of the advection fan of the first embodiment of the invention.

Referring to FIGS. 3 and 4, an advection fan including a fan frame 1, a driving module 2 and an impeller 3 is disclosed according to a first embodiment of the invention. The fan frame 1 is of a structure that allows air to flow therethrough in the radial direction. The driving module 2 is installed in the fan frame 1. The impeller 3 is rotatably coupled with the driving module 2 in order for the driving module 2 to drive the impeller 3 to rotate.

The fan frame 1 is a hollow frame structure that can receive the driving module 2 and the impeller 3 while allowing air to be drawn in and expelled from the fan frame 1 in the radial direction. The hollow frame structure may be in various geometric shapes such as a polyhedron shape, a round shape or an oval shape. In this embodiment, the fan frame 1 has a rectangular shape.

The fan frame 1 includes a first cover portion 11, a second cover portion 12 spaced from the first cover portion 11 by a distance, and a lateral wall portion 13 arranged between the first and second cover portions 11 and 12 and including an air inlet 131 and an air outlet 132. In such an arrangement, an advection fan is formed. The advection fan has a closed structure in the axial direction. The quantity and location of the air inlet 131 and the air outlet 132 may be changed based on different requirements. The first cover portion 11, the second cover portion 12 and the lateral wall portion 13 may be integrally formed. In this embodiment, the first cover portion 11 is integrally formed with the lateral wall portion 13, and the second cover portion 12 is a cover plate that can be assembled to and disassembled from the lateral wall portion 13 to allow installation of the driving module 2 and the impeller 3 into the fan frame 1. Furthermore, the air inlet 131 faces in a direction A, and the air outlet 132 faces in a direction B perpendicular to the direction A to provide an angle difference of 90 degrees therebetween (the angle difference between the air inlet 131 and the air outlet 132 can also be smaller than 90 degrees). The opening of the air outlet 132 is preferably smaller than that of the air inlet 131 to obtain a larger air pressure.

The driving module 2 can be any structure capable of driving the impeller 3 to rotate. The driving module 2 includes essential components such as a coil unit, a circuit board, a plurality of silicon steel plates, a shaft seat, etc. One skilled in the art may readily appreciate that the driving module 2 drives the impeller 3 to rotate under alternating magnetic fields (by interacting with a permanent magnet of the impeller 3), so it is not described herein again for brevity. In this embodiment, the driving module 2 includes a shaft seat 21 and a base plate 22, with the shaft seat 21 installed in the fan frame 1. The shaft seat 21 may be assembled to or integrally formed with the fan frame 1. In this embodiment, the shaft seat 21 is coupled with the first cover portion 11 of the fan frame 1. Furthermore, the base plate 22 is fitted around the shaft seat 21 and includes one face having a coil unit 221 formed by layout.

The impeller 3 is rotatably coupled with the driving module 2, and an axial air gap G is formed between the impeller 3 and the driving module 2. In contrast to the conventional advection fan with a radial air gap, the advection fan of the invention may have a smaller volume and a simplified structure based on the axial air gap structure. The impeller 3 includes a metal base plate 31, a shaft 32 coupled to the central portion of the metal base plate 31, and a plurality of plastic blades 33 coupled to the outer periphery of the metal base plate 31.

The metal base plate 31 includes a shaft-coupling portion 311 and a peripheral portion 312 distant from the shaft-coupling portion 311. Located between the shaft-coupling portion 311 and the peripheral portion 312 are a first surface 313 and a second surface 314 opposite to the first surface 313. In other words, the metal base plate 31 is preferably a flat plate between the shaft-coupling portion 311 and the peripheral portion 312. The first surface 313 faces away from the second surface 314 in a first direction D1, and the second surface 314 faces away from the first surface 313 in a second direction D2. The first surface 313 is provided with a permanent magnet 315.

The first surface 313 and the second surface 314 of the metal base plate 31 may be uncovered or covered with a plastic or rustproof film. The metal base plate 31 is preferably made of magnetic-conducting material that can provide a shielding function when the metal base plate 31 is coupled with the permanent magnet 315. The metal base plate 31 may form the shaft-coupling portion 311 by way of punching or the like. The shaft-coupling portion 311 may be any structure with which the shaft 32 can be securely coupled. In the embodiment, the shaft-coupling portion 311 is a fixing hole formed by punching process, with the fixing hole surrounded by an annular protrusion and extending from the first surface 313 to the second surface 314.

The shaft 32 has a fixing end 321 coupled with the shaft-coupling portion 311 of the metal base plate 31. The fixing end 321 of the shaft 32 may be fixed to the shaft-coupling portion 311 by ways of fastening, screwing, welding, close fitting or the like, to prevent the shaft 32 from rotating singly at the shaft-coupling portion 311 (without driving the metal base plate 31 to rotate at the same time). The top face of the fixing end 321 of the shaft 32 is preferably aligned with or below the second surface 314 of the metal base plate 31. The shaft 32 also includes a free end 322 distant from the fixing end 321 and extending axially in the first direction D1. After the shaft 32 is assembled to the metal base plate 31, the shaft 32 may be rotatably coupled with the shaft seat 21 of the driving module 2 to form the axial air gap G between the permanent magnet 315 and the coil unit 221 of the driving module 2.

Each plastic blade 33 has a coupling portion 331 and an air-driving portion 332, with the coupling portion 331 coupled with the peripheral portion 312 of the metal base plate 31. The plastic blades 33 are integrally formed with the peripheral portion 312 of the metal base plate 31 by way of injection molding for convenient manufacturing and assembly. The peripheral portion 312 of the metal base plate 31 preferably forms a saw-toothed shape, a plurality of notches, one or more bends, or other similar structures capable of preventing loosening of the plastic blades 33 when the plastic blades 33 are integrally formed with the peripheral portion 312 of the metal base plate 31.

Figure 5:
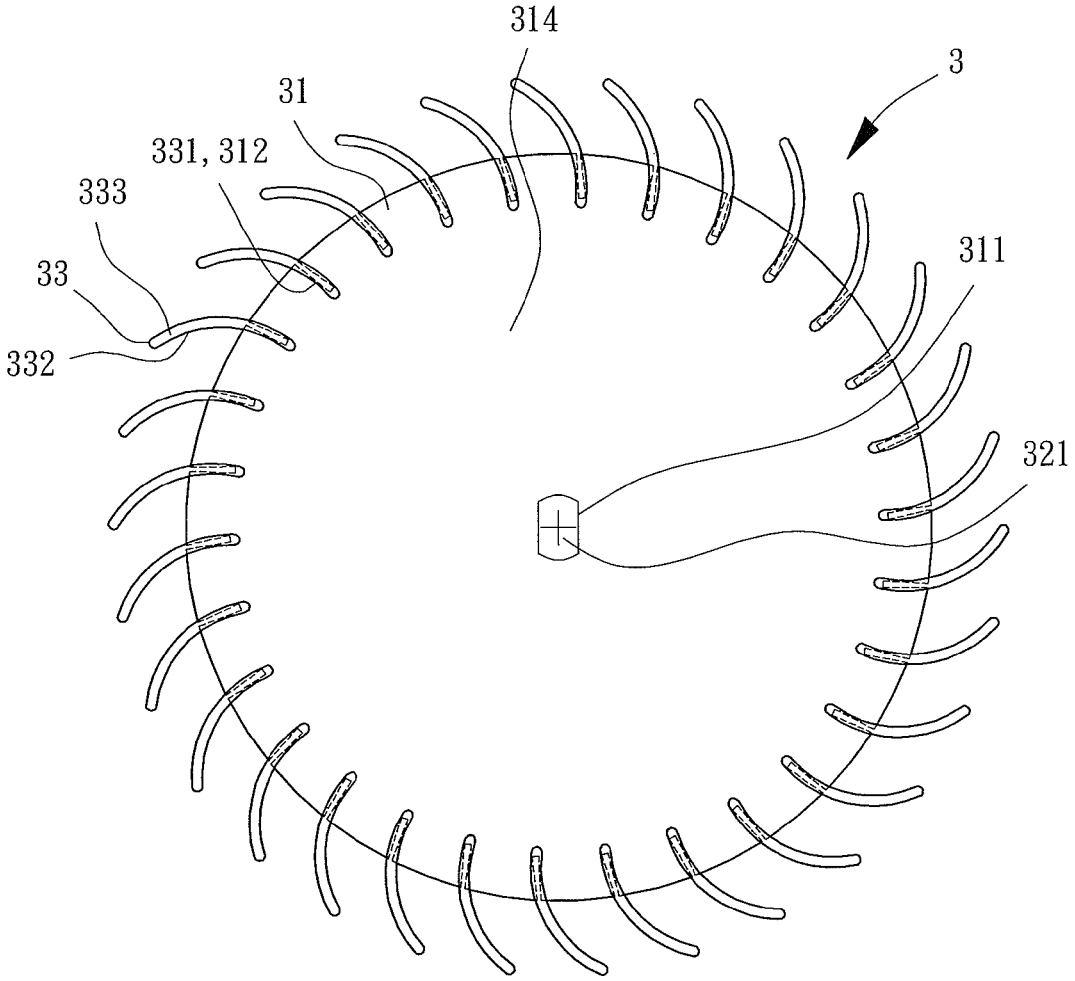
FIG. 5 is a top view of an impeller of the advection fan including a metal base plate having a peripheral portion in the form of a plurality of notches according to the first embodiment of the invention.

As an example, referring to FIG. 5, the peripheral portion 312 of the metal base plate 31 includes a plurality of notches into which the plurality of plastic blades 33 can be engaged when the plurality of plastic blades 33 is integrally coupled with the peripheral portion 312 of the metal base plate 31 by injection molding. Thus, it will efficiently prevent loosening of the plastic blades 33.

Figure 6:
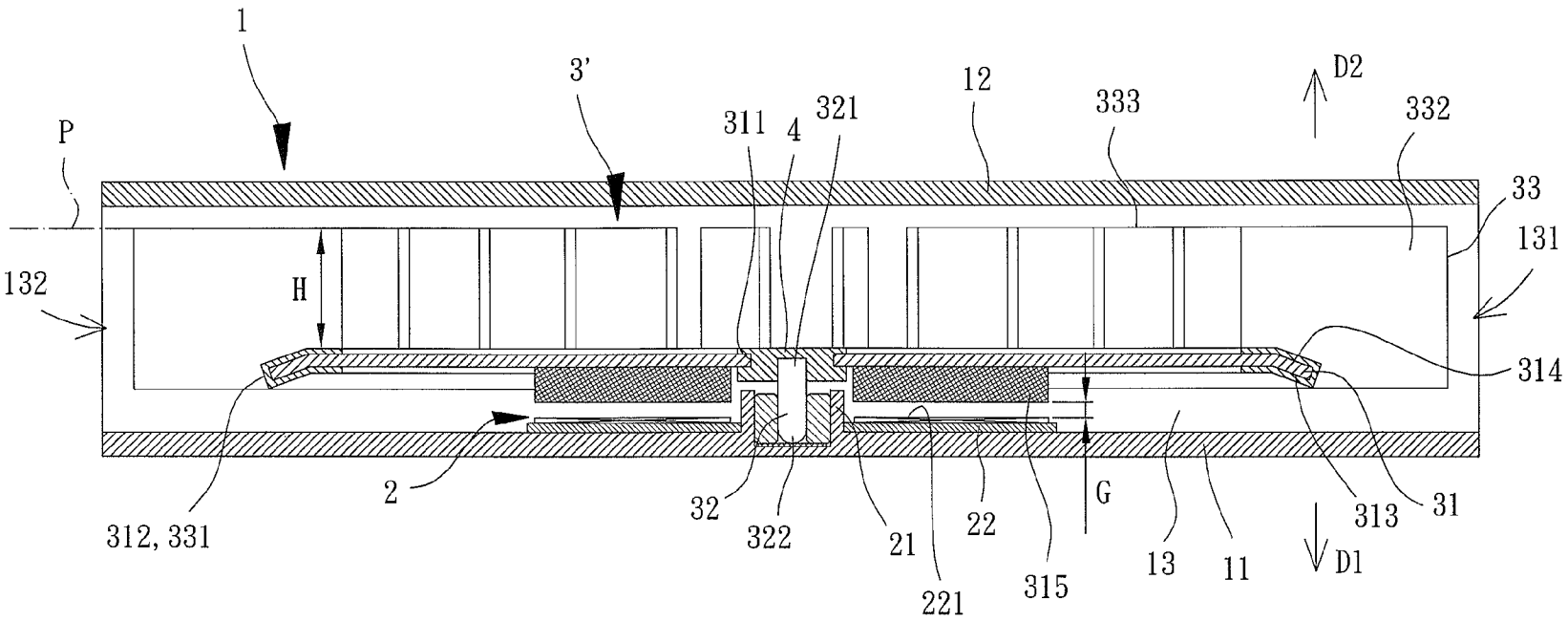
FIG. 6 is a cross-sectional view of the advection fan with the peripheral portion of the impeller forming one bend according to the first embodiment of the invention.

As another example, referring to FIG. 6, the peripheral portion 312 of the metal base plate 31 gradually extends in the first direction D1 to form one bend. Thus, the plastic blades 33 will be annularly arranged along the bend when the plurality of plastic blades 33 is integrally coupled with the peripheral portion 312 of the metal base plate 31 by injection molding. This also efficiently prevents loosening of the plastic blades 33.

Figure 7:
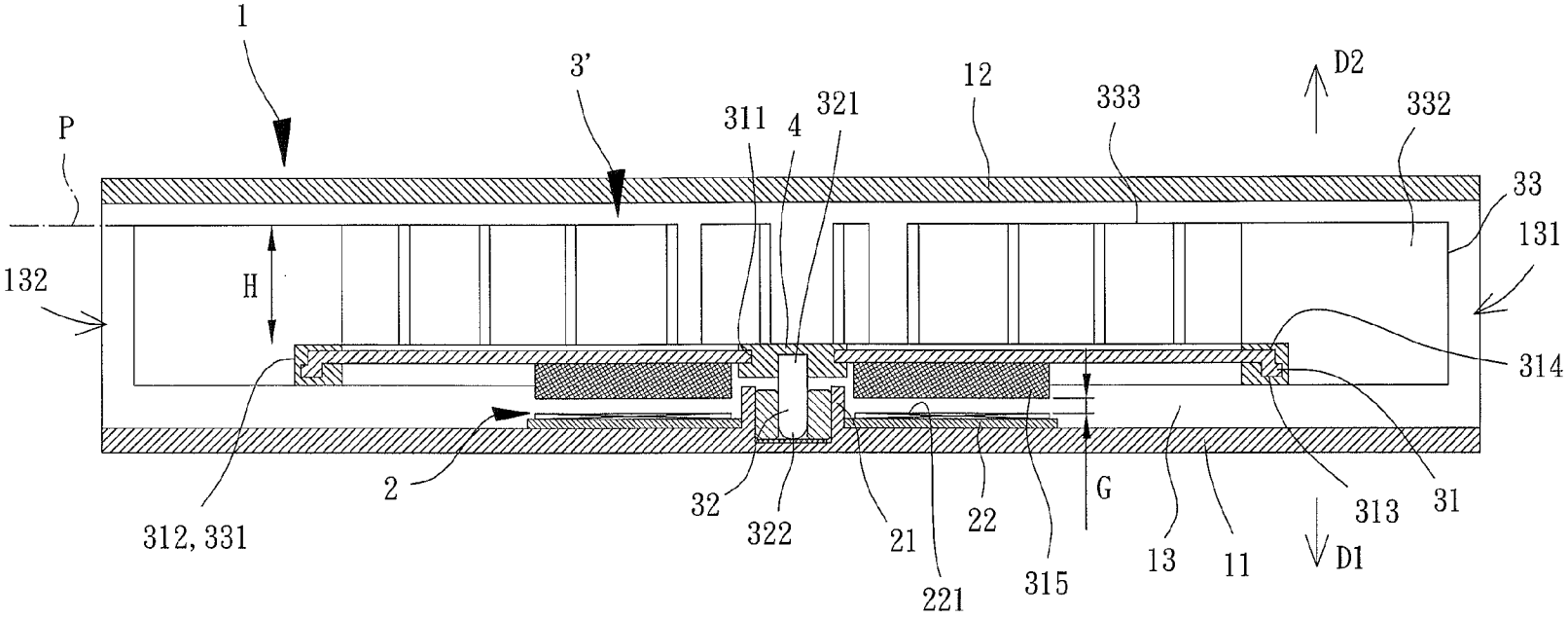
FIG. 7 is another cross-sectional view of the advection fan with the peripheral portion of the impeller forming two bends according to the first embodiment of the invention.

As another example, referring to FIG. 7, the peripheral portion 312 of the metal base plate 31 extends axially in the first direction D1 and then extends in the radial direction, thereby forming two bends. Thus, the plastic blades 33 will be annularly arranged along the two bends when the plurality of plastic blades 33 is integrally coupled with the peripheral portion 312 of the metal base plate 31 by injection molding. This also efficiently prevents loosening of the plastic blades 33.

In addition, the air-driving portion 332 of the plastic blade 33 extends axially in the second direction D2. In this arrangement, the air-driving portions 332 of the plastic blades 33 may be located above the second surface 314 of the metal base plate 31, making the impeller 3 of the invention suitable for use in an advection fan.

Each plastic blade 33 of the impeller 3 has a top edge 333 facing in the second direction D2 (namely, facing the second cover portion 12). In the embodiment, the top edge 333 of the plastic blade 33 is spaced from the second surface 314 of the metal base plate 31 by a height H. Specifically, based on the height H, the top edges 333 of the plastic blades 33 may jointly form a horizontal reference plane P in which a horizontal air-guiding area is formed between the horizontal reference plane P and the second surface 314 of the metal base plate 31. There is preferably no hub-like protrusion in the horizontal air-guiding space in order to prevent the disruption to the flow of air. The air-driving portions 332 of the plastic blades 33 are annularly arranged to form the horizontal air-guiding space. In such an arrangement, when the impeller 3 draws and expels air in the horizontal direction, the impeller 3 may smoothly guide the air into and out of the advection fan through the horizontal air-guiding space. Thus, noise generated by turbulence can be reduced, and the cooling effect of the advection fan may be greatly improved.

When the advection fan of the invention is in use, the alternating magnetic fields generated by the driving module 2 may drive the impeller 3 to rotate. Thus, the advection fan can be installed in a variety of electronic devices. The plastic blades 33 of the impeller 3 will draw air into the advection fan via the air inlet 131 and expel the air from the advection fan via the air outlet 132 to provide a cooling function for a heat source of the electronic device.

In the advection fan and the impeller of the invention, the impeller 3 is able to horizontally guide air into and out of the advection fan through the air inlet 131 and the air outlet 132. Therefore, it is no longer required to mount the advection fan on the top of the heat source, thereby reducing the height of the electronic device. In addition, it also provides an improved auxiliary cooling effect for those heat sources adjacent to the air outlet 132. More importantly, since the second surface 314 does not have any hub-like protrusion and since the air-driving portions 332 of the plastic blades 33 axially extend in the second direction D2, the incoming air can smoothly flow to the air outlet 132 through the second surface 314. The air will then be expelled at the air outlet 132. As such, the disruption to the flow of the air can be significantly reduced, preventing turbulence from forming and improving the overall cooling effect.

Furthermore, the impeller 3 consists of the metal base plate 31 and the plastic blades 33. The metal base plate 31 may be a thin plate that allows the impeller 3 to have a smaller thickness without reducing the structural strength. In addition, since the plastic blades 33 of the impeller 3 used to drive the air are made of plastic, the manufacturing costs of the impeller 3 are reduced. Thus, the impeller 3 of the invention is thin and has an improved structural strength. More importantly, since the plastic blades 33 of the impeller 3 axially extend in the second direction D2, the air-driving portions 332 of the plastic blades 33 are all located above the second surface 314. This suggests that the areas of the plastic blades 33 are large enough to allow the plastic blades 33 to efficiently guide the air into and out of the advection fan in the horizontal direction when the impeller 3 is installed in the advection fan. Therefore, the impeller 3 is suitable for use in the advection fan with smaller thickness and larger structural strength.

Figure 8:
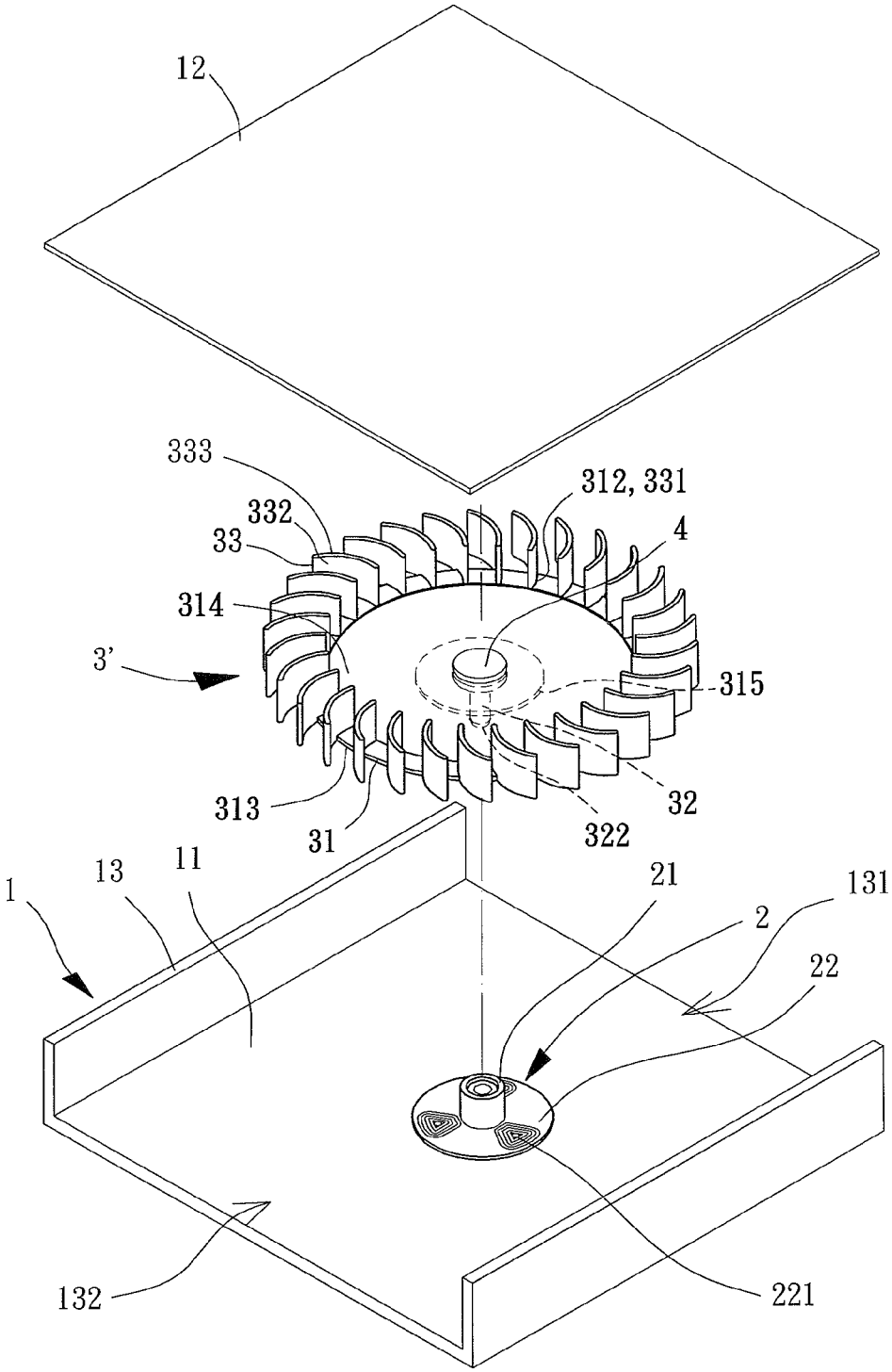
FIG. 8 is an exploded view of an advection fan according to a second embodiment of the invention.
Figure 9:
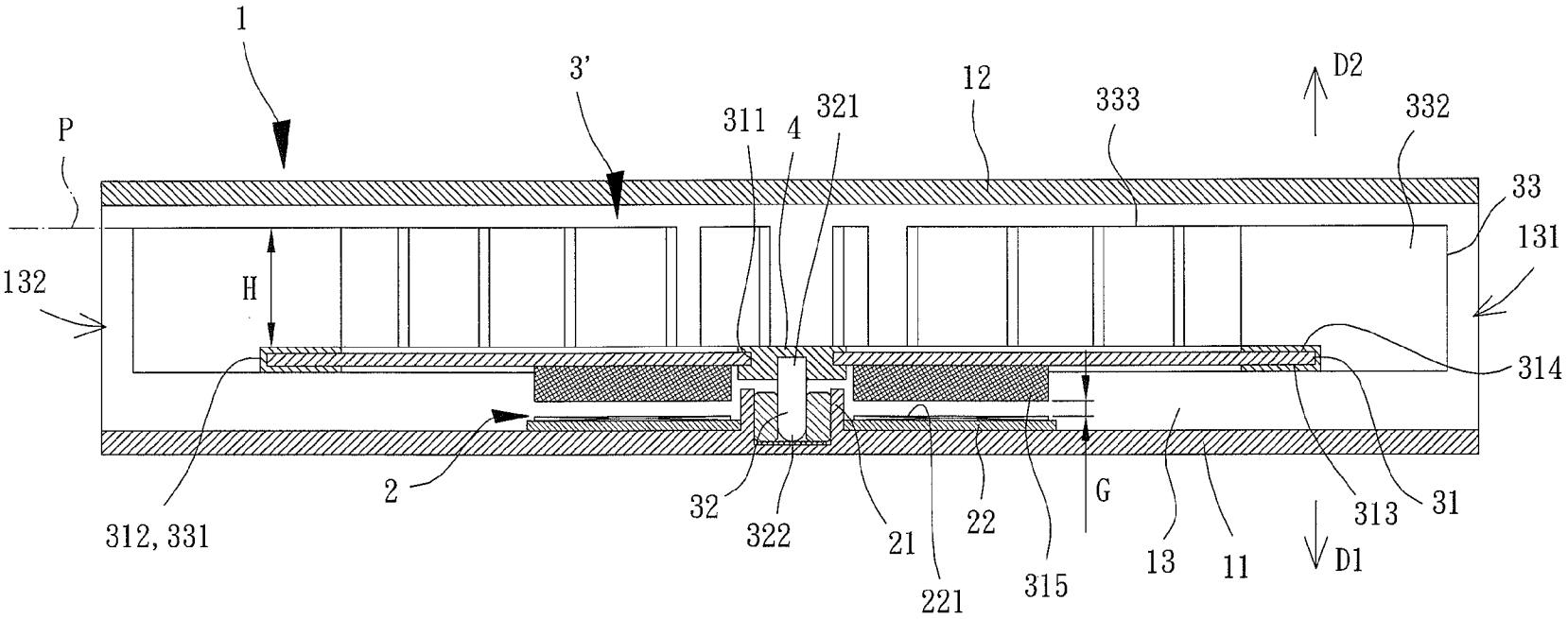
FIG. 9 is a cross-sectional view of the advection fan of the second embodiment of the invention.

Referring to FIGS. 8 and 9, an advection fan is disclosed according to a second embodiment of the invention. The advection fan also includes a fan frame 1, a driving module 2 and an impeller 3'. The fan frame 1 and the driving module 2 in this embodiment have been described in the previous embodiment, so they are not described herein again. In this embodiment, the air inlet 131 and the air outlet 132 have an angle difference of 180 degrees.

Figure 10:
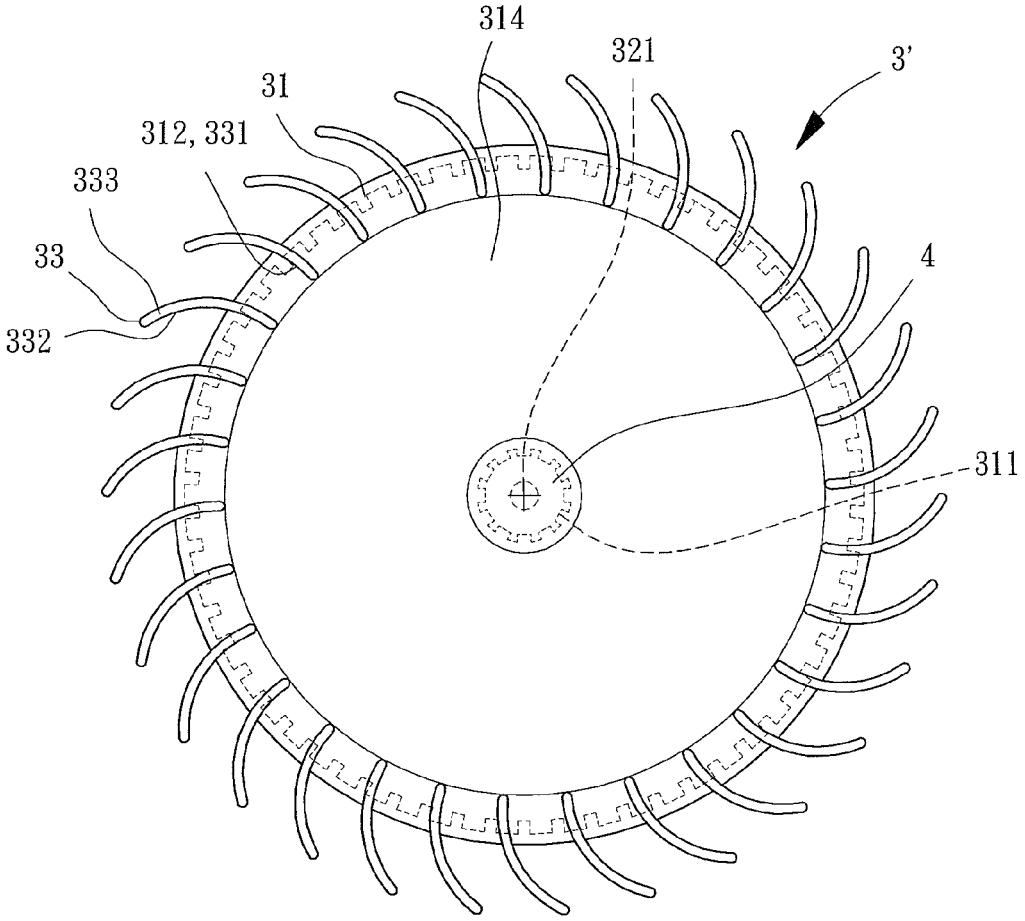
FIG. 10 is a top view of an impeller of the advection fan of the second embodiment of the invention.

The shaft 32 of the impeller 3' is preferably coupled with the shaft-coupling portion 311 of the metal base plate 31 via a shaft sleeve 4, to reinforce the coupling between the metal base plate 31 and the shaft 32 as well as providing convenient assembly between the metal base plate 31 and the shaft 32. The shaft sleeve 4 may be a plastic shaft sleeve that integrally couples the shaft 32 with the shaft-coupling portion 311 of the metal base plate 31 by way of injection molding, ensuring more secure coupling between the metal base plate 31 and the shaft 32. As shown in FIG. 10, the shaft-coupling portion 311 of the metal base plate 31 preferably forms a plurality of notches or has a saw-toothed inner periphery, a noncircular hole or the like, to efficiently prevent loosening of the shaft sleeve 4 as well as preventing the shaft sleeve 4 from rotating singly when the shaft sleeve 4 is integrally coupled with the shaft-coupling portion 311 of the metal base plate 31.

Based on the fact that the air-driving portions 332 of the plastic blades 33 of the impeller 3, 3' axially extend in the second direction D2, and since the part of the second surface 314 between the shaft-coupling portion 311 and the peripheral portion 312 is completely flat and does not have a hub-like protrusion, it will prevent the disruption to the flow of air when the plastic blades 33 of the impeller 3, 3' guide the air into and out of the advection fan in the horizontal direction. Thus, improved cooling efficiency is attained.

Based on the fact that the impeller 3, 3' of the invention may consist of the metal base plate 31 and the plastic blades 33 for reduced thickness and improved structural strength, the air-driving portions 332 of the plastic blades 33 may all be located above the second surface 314 of the metal base plate 31, since the plastic blades 33 of the impeller 3, 3' extend in the second direction D2. As such, the impeller 3, 3' is suitable for use in an advection fan that has a small thickness.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An impeller of an advection fan, comprising:

a metal base plate comprising a shaft-coupling portion, a peripheral portion distant from the shaft-coupling portion, and a first surface and a second surface between the shaft-coupling portion and the peripheral portion, wherein a direction the first surface faces away from the second surface is defined as a first direction, wherein another direction the second surface faces away from the first surface is defined as a second direction opposite to the first direction, wherein the metal base plate is a flat plate between the shaft-coupling portion and the peripheral portion;

a permanent magnet provided on the first surface;

a shaft having a fixing end and a free end distant from the fixing end, wherein the fixing end is coupled with the shaft-coupling portion of the metal base plate, and wherein the free end extends axially only in the first direction; and a plurality of plastic blades, wherein each plastic blade has a coupling portion and an air-driving portion, wherein the coupling portion is coupled with the peripheral portion of the metal base plate and radially spaced from the shaft-coupling portion, wherein the air-driving portion axially extends from the metal base plate only in the second direction and radially beyond the peripheral portion, wherein the permanent magnet is radially spaced from the peripheral portion, from the coupling portion of each plastic blade and from the plurality of plastic blades such that the plurality of plastic blades do not overlap the permanent magnet in an axial direction, and wherein the second surface of the metal base plate is not covered with a plastic or rustproof film.

2. The impeller of the advection fan as claimed in claim 1, wherein each plastic blade has a top edge facing in the second direction and spaced from the second surface of the metal base plate by a height.

3. The impeller of the advection fan as claimed in claim 2, wherein the top edges of the plurality of plastic blades jointly form a horizontal reference plane, and wherein a horizontal air-guiding space is formed between the horizontal reference plane and the second surface of the metal base plate.

4. The impeller of the advection fan as claimed in claim 3, wherein the air-driving portions of the plurality of plastic blades are annularly arranged to form the horizontal air-guiding space.

5. The impeller of the advection fan as claimed in claim 1, wherein the air-driving portions of the plurality of plastic blades are located above the second surface of the metal base plate in an axial direction.

6. The impeller of the advection fan as claimed in claim 1, wherein the fixing end of the shaft is aligned with or located below the second surface of the metal base plate.

7. The impeller of the advection fan as claimed in claim 1, wherein the plurality of plastic blades is integrally formed with the peripheral portion of the metal base plate by way of injection molding.

8. The impeller of the advection fan as claimed in claim 7, wherein the peripheral portion of the metal base plate forms a saw-toothed shape, a plurality of notches, or one or more bends.

9. The impeller of the advection fan as claimed in claim 1, wherein the shaft is coupled with the shaft-coupling portion of the metal base plate via a shaft sleeve.

10. The impeller of the advection fan as claimed in claim 9, wherein the shaft sleeve is a plastic shaft sleeve that integrally couples the shaft with the shaft-coupling portion of the metal base plate.

11. The impeller of the advection fan as claimed in claim 10, wherein the shaft-coupling portion of the metal base plate forms a plurality of notches or has a saw-toothed inner periphery or a noncircular hole.

12. The impeller of the advection fan as claimed in claim 1, wherein the first and second surfaces of the metal base plate are uncovered.

13. An advection fan comprising:

a fan frame comprising a first cover portion, a second cover portion and a lateral wall portion arranged between the first and second cover portions, wherein the lateral wall portion comprises an air inlet and an air outlet;

a driving module installed in the fan frame; and an impeller comprising a metal base plate, a shaft and a plurality of plastic blades, wherein the metal base plate comprises a shaft-coupling portion, a peripheral portion distant from the shaft-coupling portion, and a first surface and a second surface between the shaft-coupling portion and the peripheral portion, wherein a direction the first surface faces away from the second surface is defined as a first direction, wherein another direction the second surface faces away from the first surface is defined as a second direction opposite to the first direction, wherein the first surface is provided with a permanent magnet, wherein the shaft is coupled with the shaft-coupling portion of the metal base plate and rotatably coupled with the driving module, wherein each plastic blade has a coupling portion and an air-driving portion, wherein the coupling portion is coupled with the peripheral portion of the metal base plate and radially spaced from the the shaft-coupling portion, wherein the air-driving portion axially extends from the metal base plate only in the second direction and radially beyond the peripheral portion, wherein the permanent magnet is radially spaced from the peripheral portion, from the coupling portion of each plastic blade and from the plurality of plastic blades such that the plurality of plastic blades do not overlap the permanent magnet in an axial direction, and wherein the second surface of the metal base plate is not covered by a plastic or rustproof film.

14. The advection fan as claimed in claim 13, wherein the driving module comprises a shaft seat and a base plate, wherein the shaft seat is arranged on the first cover portion of the fan frame, wherein the shaft of the impeller is coupled with the shaft seat of the driving module, wherein the base plate is fitted around the shaft seat and includes one face having a coil unit, and wherein the permanent magnet and the coil unit are spaced from each other by an axial air gap.

15. The advection fan as claimed in claim 13, wherein the first and second surfaces of the metal base plate between the shaft-coupling portion and the peripheral portion is flat.

16. The advection fan as claimed in claim 13, wherein each plastic blade has a top edge facing in the second direction and spaced from the second surface of the metal base plate by a height.

17. The advection fan as claimed in claim 16, wherein the top edges of the plurality of plastic blades jointly form a horizontal reference plane, and wherein a horizontal air-guiding space is formed between the horizontal reference plane and the second surface of the metal base plate.

18. The advection fan as claimed in claim 17, wherein the air-driving portions of the plurality of plastic blades are annularly arranged to form the horizontal air-guiding space.

19. The advection fan as claimed in claim 13, wherein the air-driving portions of the plurality of plastic blades are located above the second surface of the metal base plate in an axial direction.

20. The advection fan as claimed in claim 13, wherein the fixing end of the shaft is aligned with or located below the second surface of the metal base plate.

21. The advection fan as claimed in claim 13, wherein the plurality of plastic blades is integrally formed with the peripheral portion of the metal base plate by way of injection molding.

22. The advection fan as claimed in claim 21, wherein the peripheral portion of the metal base plate forms a saw-toothed shape, a plurality of notches, or one or more bends.

23. The advection fan as claimed in claim 13, wherein the shaft is coupled with the shaft-coupling portion of the metal base plate via a shaft sleeve.

24. The advection fan as claimed in claim 23, wherein the shaft sleeve is a plastic shaft sleeve that integrally couples the shaft with the shaft-coupling portion of the metal base plate.

25. The advection fan as claimed in claim 24, wherein the shaft-coupling portion of the metal base plate forms a plurality of notches or has a saw-toothed inner periphery or a noncircular hole.

26. The advection fan as claimed in claim 13, wherein the first and second surfaces of the metal base plate are uncovered.

27. The advection fan as claimed in claim 13, wherein the air outlet has a smaller opening than the air inlet.

* * * * *